US005078622A

United States Patent [19]

Hunt, III et al.

[11] Patent Number: 5,078,622

[45] Date of Patent: Jan. 7, 1992

[54] PIN AND SOCKET ELECTRICAL CONNECTOR WITH ALTERNATE SEALS

[75] Inventors: Alexander Hunt, III, Harrisburg; Lori A. Mayer, Newport; Keith R. Denlinger, Lancaster, all of Pa.

[73] Assignee: AMP Incorporated, Harrisburg, Pa.

[21] Appl. No.: 616,163

[22] Filed: Nov. 20, 1990

Related U.S. Application Data

[62] Division of Ser. No. 353,351, May 17, 1989, abandoned.

[51] Int. Cl.[5] ..... H01R 13/40

[52] U.S. Cl. ..... 439/589; 439/282; 439/599; 439/752

[58] Field of Search ..... 439/282, 587, 589, 594, 439/595, 598, 599, 603, 752

[56] References Cited

U.S. PATENT DOCUMENTS 4,735,581 4/1988 Endo et al. ..... 439/587

4,895,533 1/1990 Yagi et al. ..... 439/587

*Primary Examiner*—Paula A. Bradley

*Attorney, Agent, or Firm*—Allan B. Osborne

[57] ABSTRACT

A pin and socket connector using pin and socket terminals formed into a highly conductive material and using a separate contact band member less resistant to stress relaxation than the material used to form a stamped and formed pin and socket terminals is disclosed. These pin and socket terminals are suitable for use in both sealed and unsealed electrical connectors, employing a secondary lock. The secondary lock has at least one cylindrical projection engaging the corresponding terminals within the cavities from the rear. At least one curved concentric opening radially spaced from a central wire and terminal receiving opening in a rear conductor seal, is configured to receive a corresponding cylindrical secondary lock projections and establish sealing integrity therewith.

7 Claims, 9 Drawing Sheets

PIN AND SOCKET ELECTRICAL CONNECTOR WITH ALTERNATE SEALS

This application is a divisional of application Ser. No. 07/353,351, filed May 17, 1989, now abandoned.

BACKGROUND OF THE INVENTION

1. Field of the Invention

This invention relates to electrical connectors, particularly matable pin and socket electrical connectors. More particularly, this invention relates to electrical connector using a separate spring band to establish an interconnection to mating male and female contact terminals. This invention also particularly relates to sealed electrical connectors and also to electrical connectors employing secondary locking features.

2. Description of the Prior Art

Disconnectable electrical connectors commonly employ either stamped and formed contact terminals or screw machined contact terminals. Stamped and formed contact terminals are generally formed by stamping a blank from a flat electrically conductive spring metal and then forming that terminal into a mating configuration. Screw machined connectors on the other hand, are generally formed by machining a solid metal member formed of an electrically conductive material into an appropriate terminal shape. Resilient contact elements or contact bands are often used with screw machined contact members to establish a spring loaded interface. U.S. Pat. No. 4,662,706 and U.S. Pat. No. 4,752,253 disclose jack and plug contacts with employ a separate spring metal band to form both an electrical and mechanical interconnection. Spring metal contact bands suitable for use in disconnectable electrical joint and connectors are discussed in a publication entitled "Guide to Multiple Contact Band Technology" published in January 1988 by Hugin Industries Incorporated.

The most common technique of fabricating pin and socket connectors is to employ stamped and formed contact terminals. Typical pin and socket contact terminals are disclosed in U.S. Pat. No. 4,708,662. As shown in that patent, typical pin and socket connectors can have a plurality of stamped and formed pin or socket terminals mounted within a molded insulative housing. The pin and socket terminals shown in that patent are held in position within the contact housing by snapping a rear locking member into place That connector shows the use of resilient latching fingers on the rear loaded locking member. U.S. Pat. No. 4,013,331 discloses the use of resilient plastic locking members formed as part of an electrical connector housing. Other examples of such rear locking members are U.S Pat. No. 4,660,915, U.S. Pat. No. 4,752,251 and U.S. Pat. No. 4,722,704. Such rear loaded secondary locks are quite satisfactory in unsealed connector applications. However, in sealed connectors such as that shown in U.S. Pat. No. 4,767,350, conductor seals placed at the rear of an insulative housing limit access from the rear, making it difficult to use a rear loaded secondary lock. U.S. Pat. No. 4,684,190 shows one sealed connector employing a secondary or auxiliary locking member which is loaded from the side. However, the insulative bodies in which these auxiliary locking combs are mounted must be positioned within a outer shroud, and these auxiliary locking combs are positioned on the interior of the sealing envelope.

SUMMARY OF THE INVENTION

The instant invention includes a stamped and formed electrical connector utilizing a separate seal and multiple contact band interface member between stamped and formed pin and socket terminals. The separate multiple contact band interface members are formed of a spring material which is more resistant to stress relaxation than the high conductivity material used to form the pin and socket contact terminals, thus assuring a long life electrical interface. The separate multiple contact interface members include a plurality of discrete elongate bands extending between circumferential hoop members located at each end of the interface member. Although the separate interface member can be made of a material which is less electrically conductive than the material used to form the stamped and formed pin and socket terminals, the electrical path length of the separate interface member is relatively short in comparison to the length of the pin and socket terminals.

Pin and socket terminals of this type can be employed in an electrical connector in which a cylindrical secondary lock member can be inserted into the rear of an insulative housing with a projecting portion extending into cavities in which the pin and socket contact terminals are retained This secondary lock member can engage the rear ends of the pin and socket contact terminals to firmly secure these contact terminals in the housing. The pin and socket terminals and the secondary lock member employed in this invention are suitable for use in a sealed and an unsealed configuration. The portion of the secondary lock projecting into the housing cavities is generally cylindrical in shape, comprising a portion of a cylindrical surface generated about an axis corresponding to the longitudinal axis of the housing cavities This cylindrical projection extends through a curved opening in a rear seal member This curved opening extends only partially around a central opening through which either the generally circular pin or socket terminal can be inserted. Thus, sealing integrity is established not only with the conductor to which the pin or socket terminal is crimped, but also with the generally cylindrical projection inserted below and in generally partial concentric relation to the wire. Thus, sealing interfaces form not only with a wire but also with a secondary light projection.

BRIEF DESCRIPTION OF THE DRAWINGS

FIG. 3 is a side view showing a stamped and formed pin terminal suitable for use with a stamped and formed socket terminal shown in FIG. 2.

FIG. 4 is an end view of the multiple band contact interface member in an undeflected state FIG. 5 is a prospective view of two single position plug connector housings showing front and rear views of the plug housing.

FIG. 13 is an alternate embodiment of a two position plug connector of the same general type as that depicted in FIGS. 1-12.

DETAILED DESCRIPTION OF THE PREFERRED EMBODIMENTS

Figures 1, 4A, 4B:
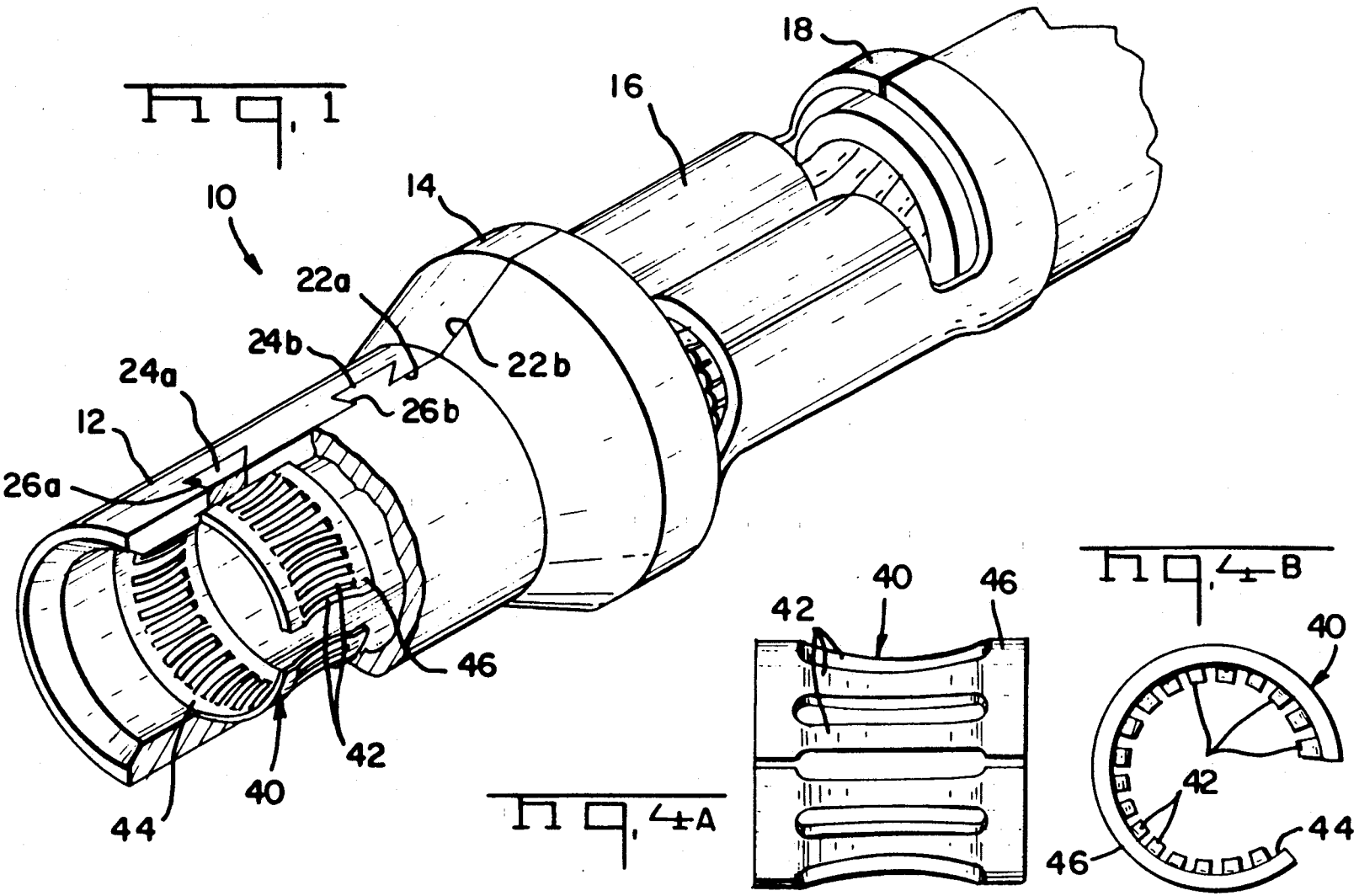
FIG. 1 is a prospective view, partially in section showing a socket terminal with a separate multiple contact band interface member mounted within a recess in the barrel portion of the socket terminal.
FIG. 4A is a side view of the separate multiple band contact interface member.
Figure 2:
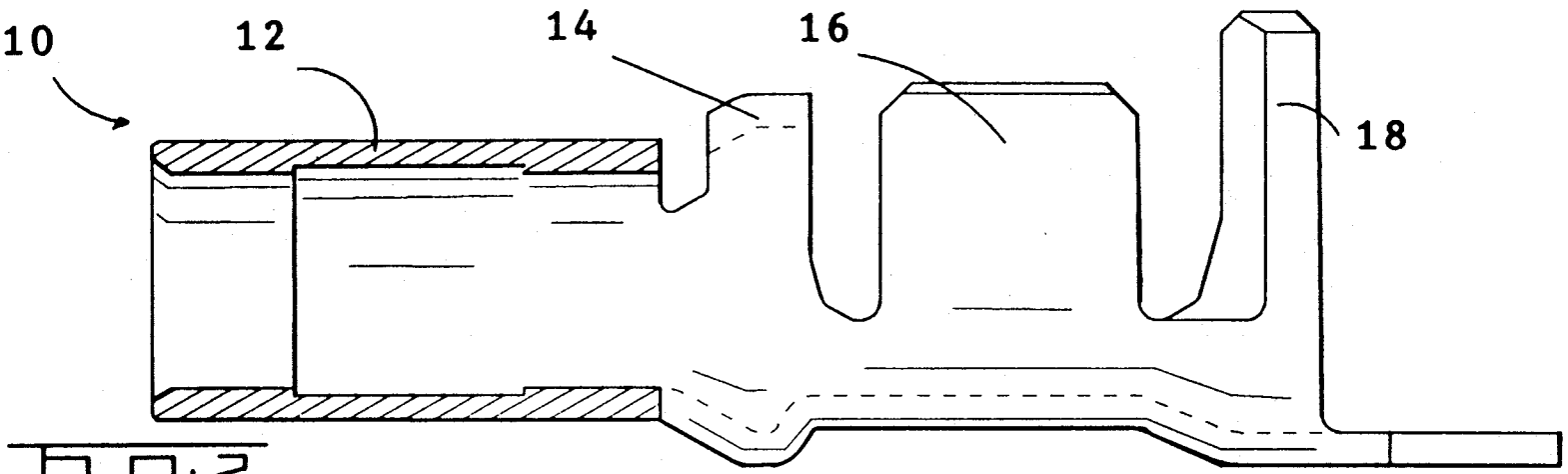
FIG. 2 is a side view, partially in section, showing a socket terminal.
Figure 1:
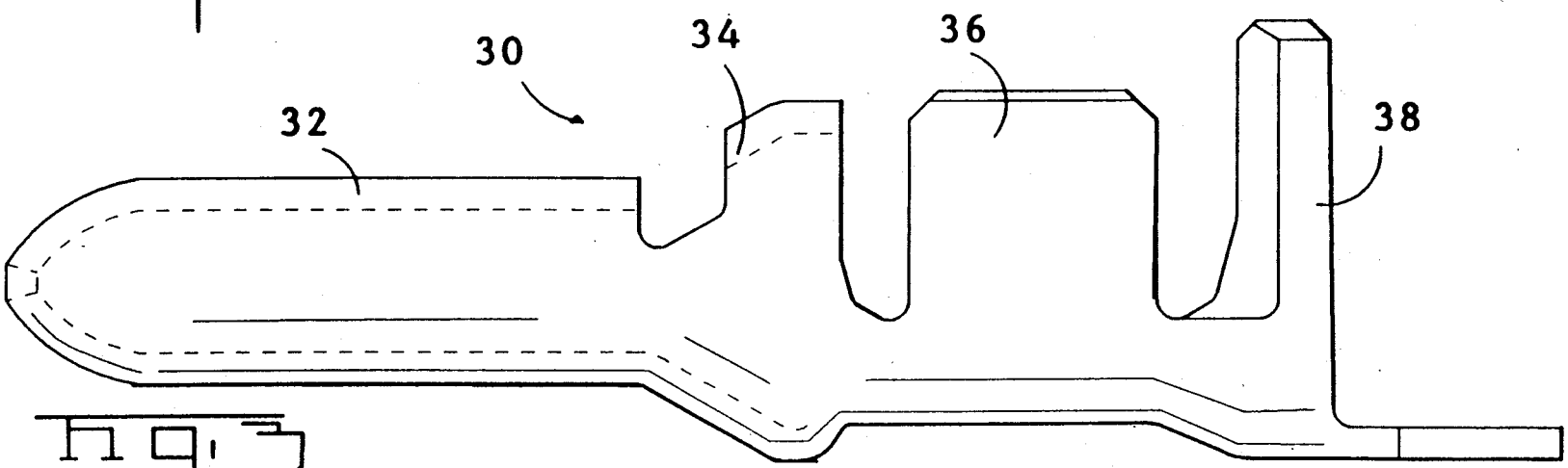
Figure 7:
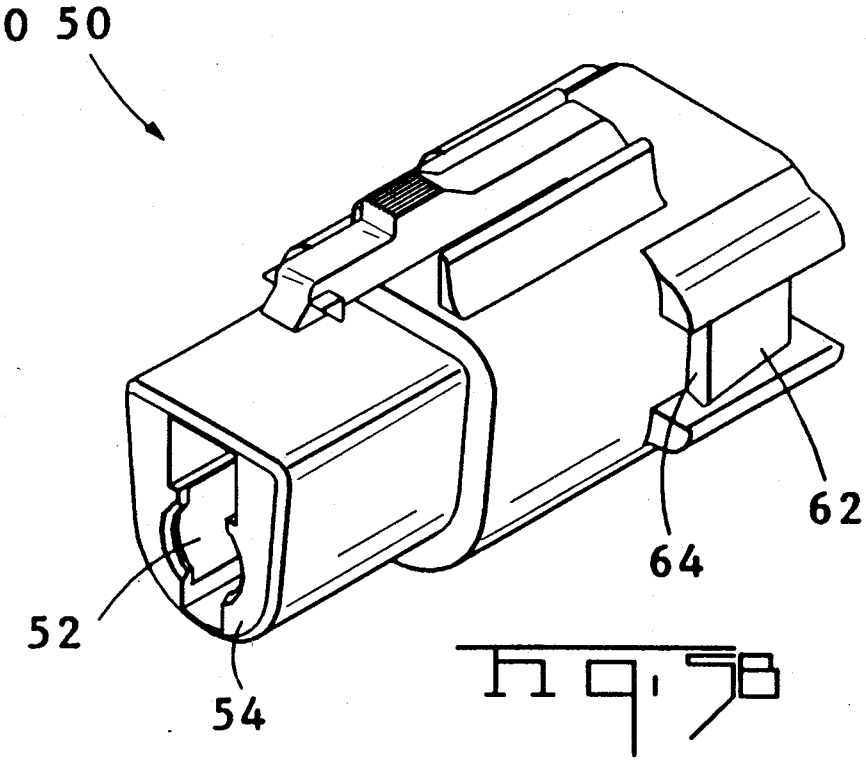
FIG. 7 is a prospective view of two single position receptacle connector housings showing front and rear views of the receptacle housing.
Figure 7A:
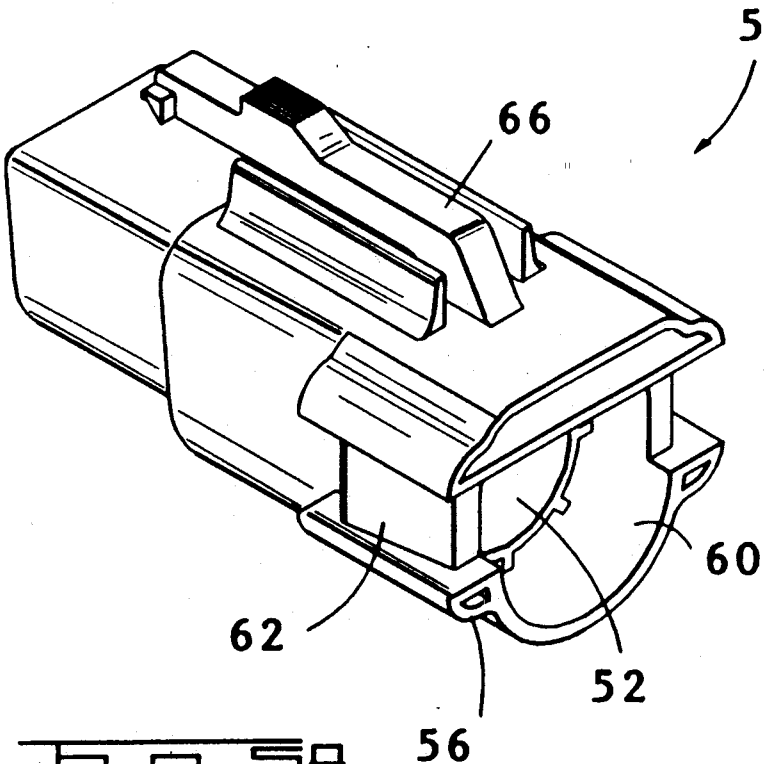
Figure 6:
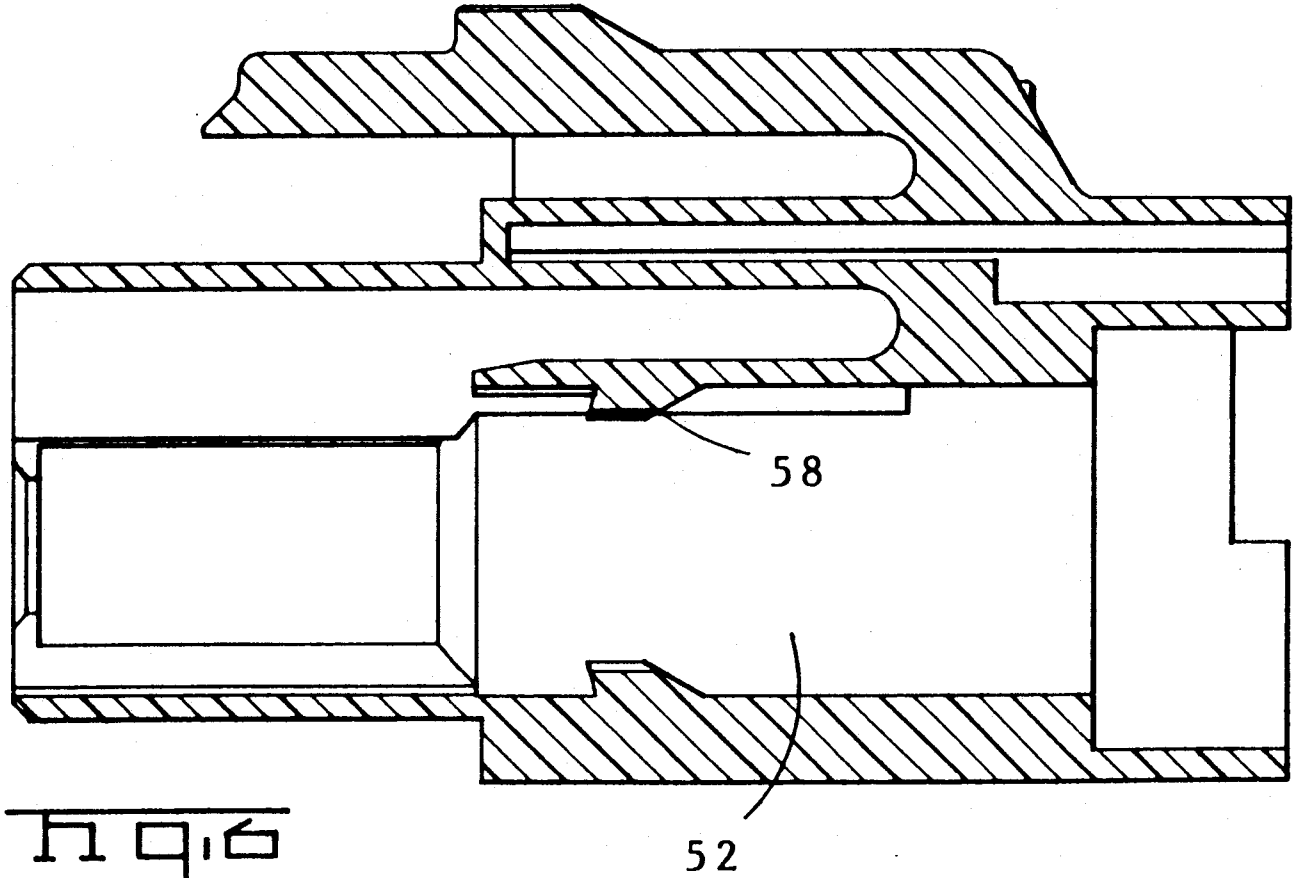
FIG. 6 is a sectional view the plug connector housing shown in FIG. 5.
Figure 7B:
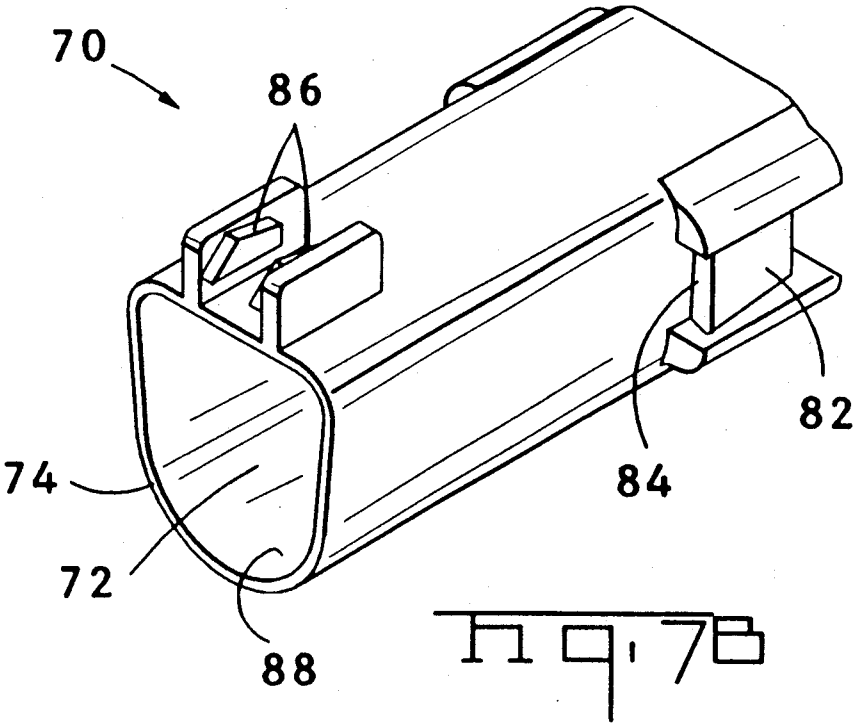
Figure 7A:
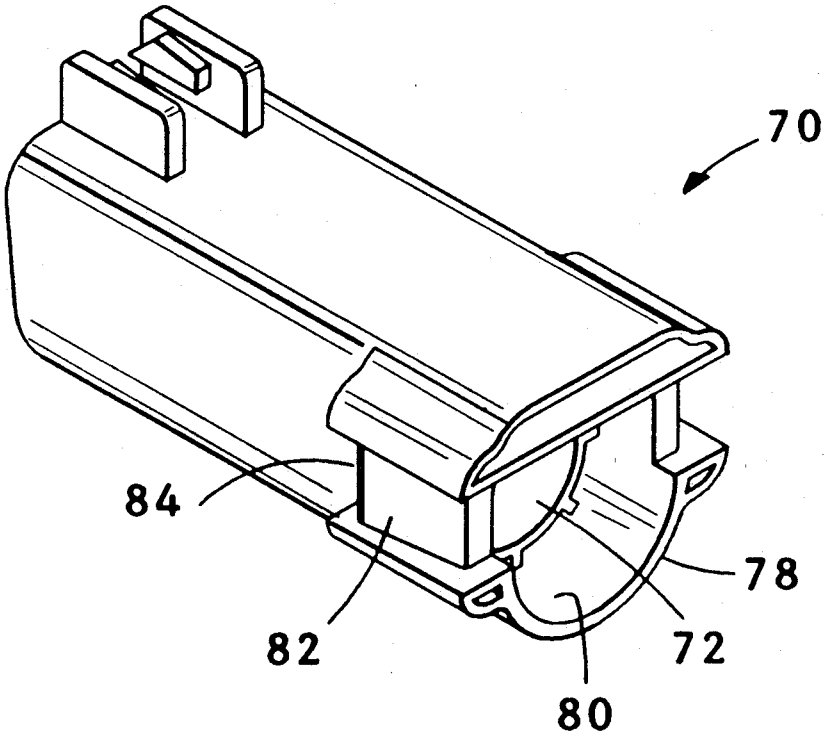

A plug connector and a receptacle connector together comprise an electrical connector assembly for interconnecting two wires. The first embodiment of the electrical connector assembly employs single position plug and receptacle connectors Socket terminals 10 or pin terminals 30 can be crimped to wires 8 and inserted into either a plug housing 50 or a receptacle housing 70 to form the first and second connectors.

Both the socket terminal 10 and the pin terminal 30 comprise stamped and formed members fabricated of an electrically conductive material. In the preferred embodiment of this invention both the socket terminal 10 and the pin terminal 30 are fabricated using pure copper having a silver plating. Although the use of pure copper with a silver plating results in an electrical connector having superior electrical conductivity, copper is generally quite susceptible to stress relaxation and is generally considered unsatisfactory for used in a stamped and formed contact terminal.

The general construction of socket contact terminal 10 is in some respects similar to conventional stamped and formed socket terminals. As with conventional stamped and formed socket terminals, socket 10 includes a socket barrel 12 at the front or mating end with a crimped section 16 located intermediate at the ends and with a stabilizing ring 18 located at the rear. A cylindrical bulge is 14 of the type shown in the socket terminals of U.S. Pat. No. 4,708,662 is located intermediate in the mid-section of the socket 10 between the socket barrel 12 and the crimp section 16. The socket barrel 12 and the bulge 14 both have a generally circular outer surface and the stamped and formed socket terminal forms a generally cylindrical cross-section.

Socket 10 differs from conventional stamped and formed sockets in that the socket barrel 12 has a recess 20 extending completely around its inner periphery. In the preferred embodiment of this invention, recess 20 is formed by first milling the flat stock used to form the stamped and formed socket contact terminal 10. Socket 10 further differs from conventional socket terminals in that the abutting edges 22A and 22B include tabs **24*a* and 24*b* protruding from edges 22*b* and grooves recessed into edges 22*a*. Tabs 24*a* and *b* have a generally trapezoidal configuration and are dimensioned to fit within trapezoidal grooves 26*a* and 26*b*. When tabs 24*a* and *b* are received within trapezoidal grooves 26*a* and *b*, a dovetail interconnection is formed between abutting edges 22*a* and 22*b* in the socket barrel portion 12 of socket terminal 10 This dovetail configuration effectively resists parting of the abutting edges when subjected to a radially directed load In the preferred embodiment of this invention one of the trapezoidal tabs 24*a* and one of the trapezoidal grooves 26*b* are formed within the milled recess 20 of the socket barrel 12**.

In the preferred embodiment depicted herein, the pin 30, is of generally conventional construction having a cylindrical barrel 32 located at the front or mating end with a cylindrical bulge 34 formed between the crimp section 36 and the barrel 32. Stabilizing ring 38 is located at the rear of the pin terminal. In the preferred embodiment of this invention pin,30 is formed of the same high conductive material as socket 10. As with socket 10, the pin 30, especially after the crimp section 36 is crimped to a wire and the insulation strain relief 38 is formed around a wire, has a generally cylindrical or circular shape, suitable for insertion in a hole in a rear conductor seal.

The resilient multiple contact band interface member 40 shown in FIGS. 1 and 4 comprises a resilient member for forming a mating electrical and mechanical interface with the stamped and formed pin and socket terminals In the preferred embodiment, the separate resilient multiple contact band interface member 40 is formed of a material less subject to stress relaxation than the the highly conductive material used in the stamped and formed pin and socket terminals 30 and 20 respectively. In the preferred embodiment, the interface member 40 is formed of beryllium copper. Interface member 40 has a plurality of elongate bands 42 extending between a front hoop member 44 and a rear hoop member 46. These hoop members 44, 46 are generally circumferential and are suited to conform to the inner contour of the socket terminal 10. In the preferred embodiment, the multiple contact band interface member 40 is configured to be secured on the interior of the socket 10. It should be understood however, that a circumferential contact band interface member having convex elongate bands, similar in function to the concave elongate bands 42, could be secured within a recess on the exterior of a stamped and formed pin terminal, otherwise, of the same type as pin 30.

The discrete elongate bands 42 extending between the hoop members 44 and 46 at opposite ends are separately engagable with the mating pin or socket contact terminal and form an independent electrical and mechanical therewith. The circumferential hoop members 44 and 46, which are subject to outwardly directed loads, establishes a satisfactory connection to the socket within the recess 20 in which interface member 40 is located. In the preferred embodiment a resilient interface member 40 of the type discussed on page 25 of "Guide to Multiple Contact Band Technology" published by Hugin Industries Inc. in January 1988, is suitable for use in this invention. Although the electrical conductivity of the contact band interface member 40 is less than that of the pin terminals, as is the conductivity of beryllium copper used in the interface member 40 in comparison to silver plated copper used in the pin and socket terminals, the effective length of the interface member and of the elongate bands 42 is less than that of the pin and socket to form a shorter electrical path length than either the pin or the socket. Resilient engagement with both the pin and socket by this separate circumferential multiple contact band interface member 40 thus insures a satisfactory electrical connection.

The preferred embodiment depicted herein comprises a single position electrical connector assembly A single position plug housing 50, formed of any suitable insulative material has a cavity 52 extending between a front end 54 and a rear end 56. A resilient housing contact latch 58 extends into the upper portion of cavity 52. This housing contact latch 58 is the type suitable for establishing engagement with a terminal inserted therein and in the preferred embodiment, this housing contact latch 58 engages the rear of cylindrical bulge 14 of a socket terminal 10 when inserted to the cavity 52 A seal pocket 60, having inner bore generally larger than the inner bore of cavity 52 is formed at the rear of the housing 50. Secondary lock latching grooves 62 are formed on the exterior of the plug housing 50 at the rear end. A forwardly facing shoulder 64, spaced from the rear end 56 of the plug housing is located at the terminus of the latching grooves 62 A suitable connector latching member 66 is located on the exterior of plug housing 50.

Figure 8:
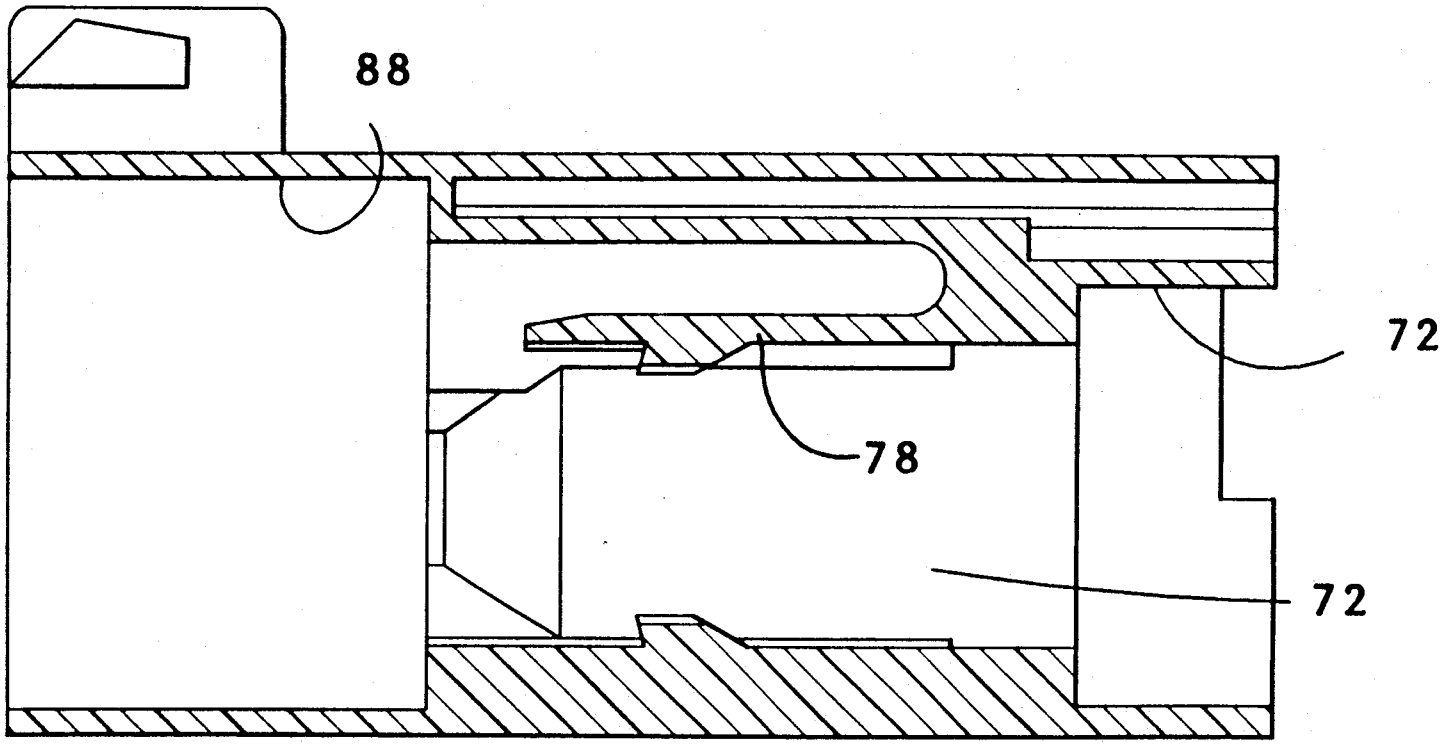
FIG. 8 is a sectional view of the receptacle housing shown in FIG. 7.
Figure 10:
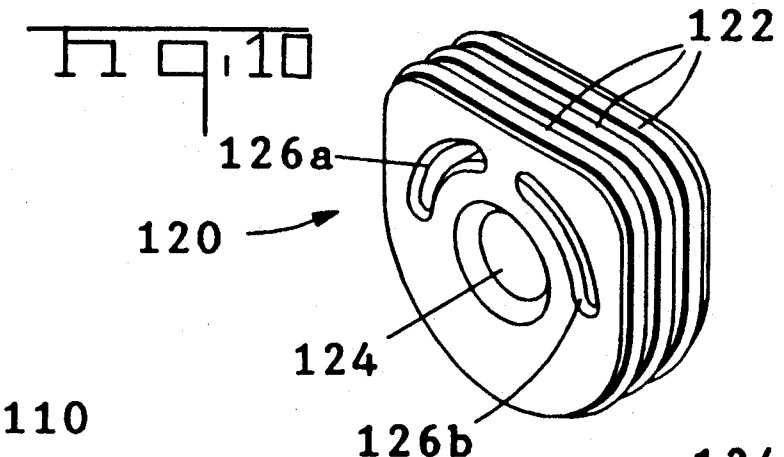
FIG. 10 is a view of the conductor seal which can be located in the rear of the insulative housing shown in FIGS. 5 and 7.
Figure 11:
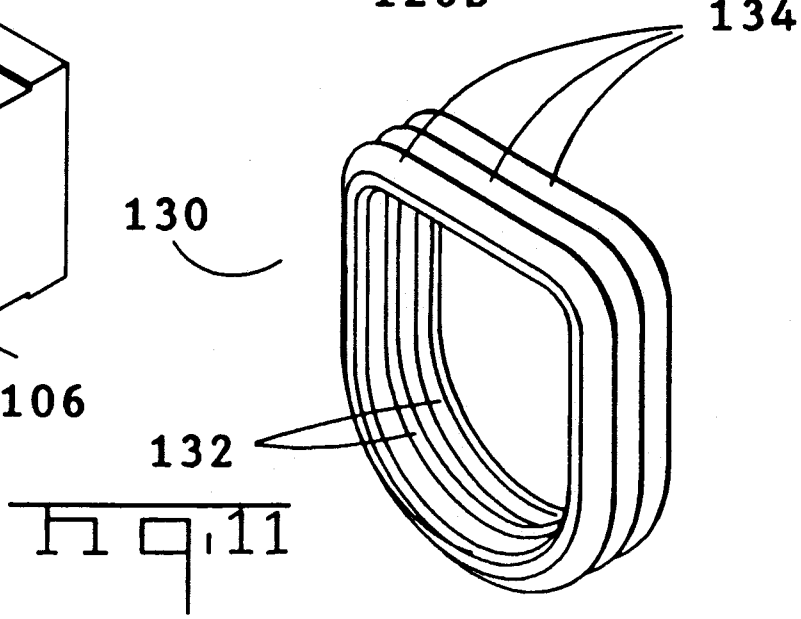
FIG. 11 is a view of an interfacial seal used to seal the mating interface between the plug and receptacle.

Receptacle housing 70 is the type suitable for mating with plug housing 50 It too includes a cavity 72 extending between a front end 74 and a rear end 76. Housing contact latch 78 shown in FIG. 8, substantially identical to housing contact latch 58 is located in cavity 72 and it too is suitable for engaging the rear of a cylindrical bulge 34 on the pin terminal 30. Seal pocket 80, substantially the same as seal pocket 60, is located on the rear of the receptacle housing 70 and secondary lock latching grooves 82 are formed on opposite ends and terminate in a shoulder 84 as with the same latching grooves and shoulders 62 and 64 on the plug housing 50. Connector latching shoulders 86 are formed on the exterior of the receptacle housing 70. These latching shoulders 86 are suitable for engagement with the connector latch 66 on the plug housing 50. An interfacial seal pocket 88 located at the front end of cavity 72 forms a seal surface on the interior of the receptacle housing. Seal pocket 88 receives seal 130 for establishing sealing integrity with the exterior of the front portion of the plug housing and with the interior surface of interfacial seal pocket 88 when mating plug and receptacle connectors are mated.

Figure 9:
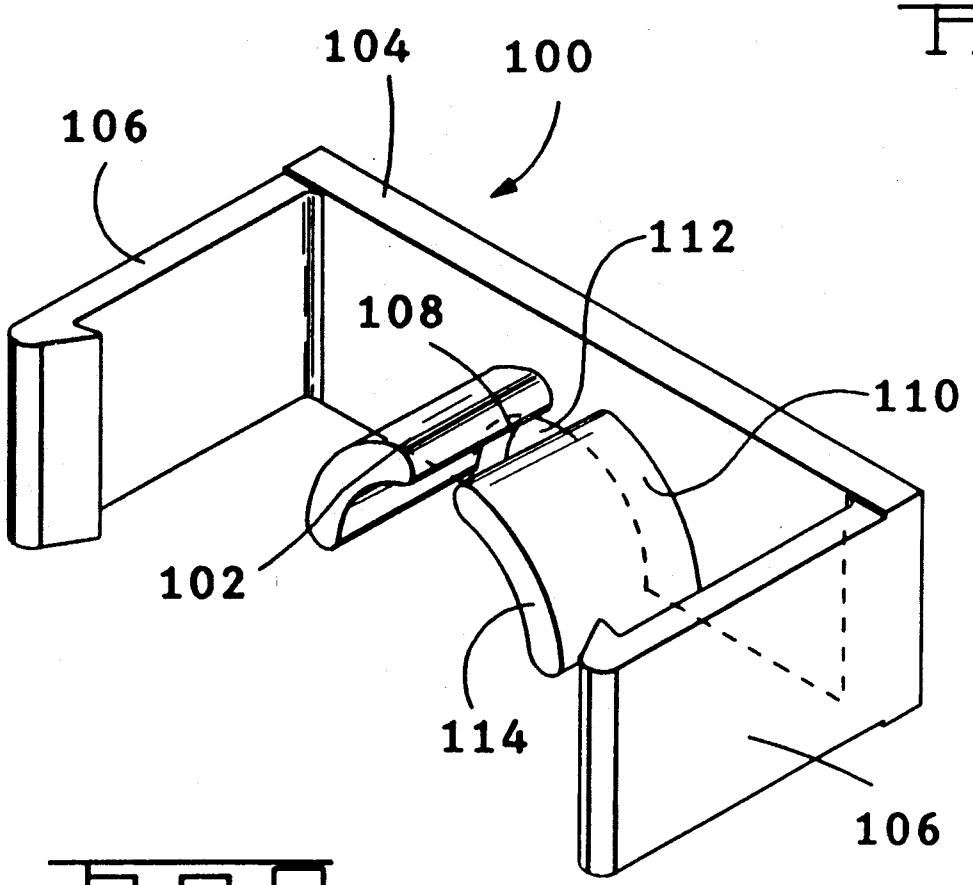
FIG. 9 is a perspective view of a single position secondary lock member suitable for use in the connector housings of FIGS. 5 and 7.

A secondary lock 100 insertable into the rear of the connector housing is suitable for use in either a sealed or unsealed version of this electrical connector assembly. Secondary lock 100 includes secondary lock cylindrical projections 102, 110 extending from a base 104. Latch arms 106 are formed on opposite ends of the base 104 and are suitable for receipt within latching grooves 62 and/or 82 and engagement with shoulders 64 and/or 84. The cylindrical projections 102, 110 are dimensioned for receipt in cavities 52 and 72 and comprise curved portions of a cylindrical surface generated about a longitudinal axis which corresponds to the longitudinal axis of the cavity. The cylindrical portion projections 102, 110 do not extend completely around the cavity but are only located at the upper end as viewed in FIG. 9 A semicircular recess 112 is formed at the base 104 and the cylindrical projections 102, 110 extends above this semicircular recess When inserted into the housing cavities 52 and 72, the front end of the cylindrical projections form a contact abutting faces 114 which engage the stabilizing rings 18, 38 of the corresponding pin or socket terminal which have been formed into a substantially circular configuration. A slot 108 extend inwardly from the contact abutting faces 114 separates cylindrical projection 102 from projection 110.

Conductor seal 120 comprises a seal of a conventional elastomeric material having sealing properties. Seal 120 has external sealing ribs 122 engagable with the internal surface of the conductor seal pockets 60 and 80 located at the rear of the housings 50 and 70. This seal has a central or inner opening 124 through which a pin or socket terminal can be inserted. The seal member is of sufficient resilience that sealing integrity will be established around a wire 8 extending through the central inner opening 124. Second curved openings **126*a* and 126*b* comprise a partially concentric curved openings having the same center as the central or inner opening and spaced from the central or inner opening 124. The curved opening 126*a*, 126*b* are shaped to conform generally to the cylindrical contour of the secondary latch projections 102 and 110. When the cylindrical projections 102, 110 are inserted through the concentric curved openings 126*a*, 126*b* sealing integrity is established between seal 120 and the seal surface 110 adjacent the base 104 of the secondary lock 100. Note that since the curved openings are generally concentric relative to the central opening 124 forming the seal around conductor 8**, stresses are essentially balanced so that sealing integrity can be established both with the wire and with the curved secondary lock projection.

Figure 12:
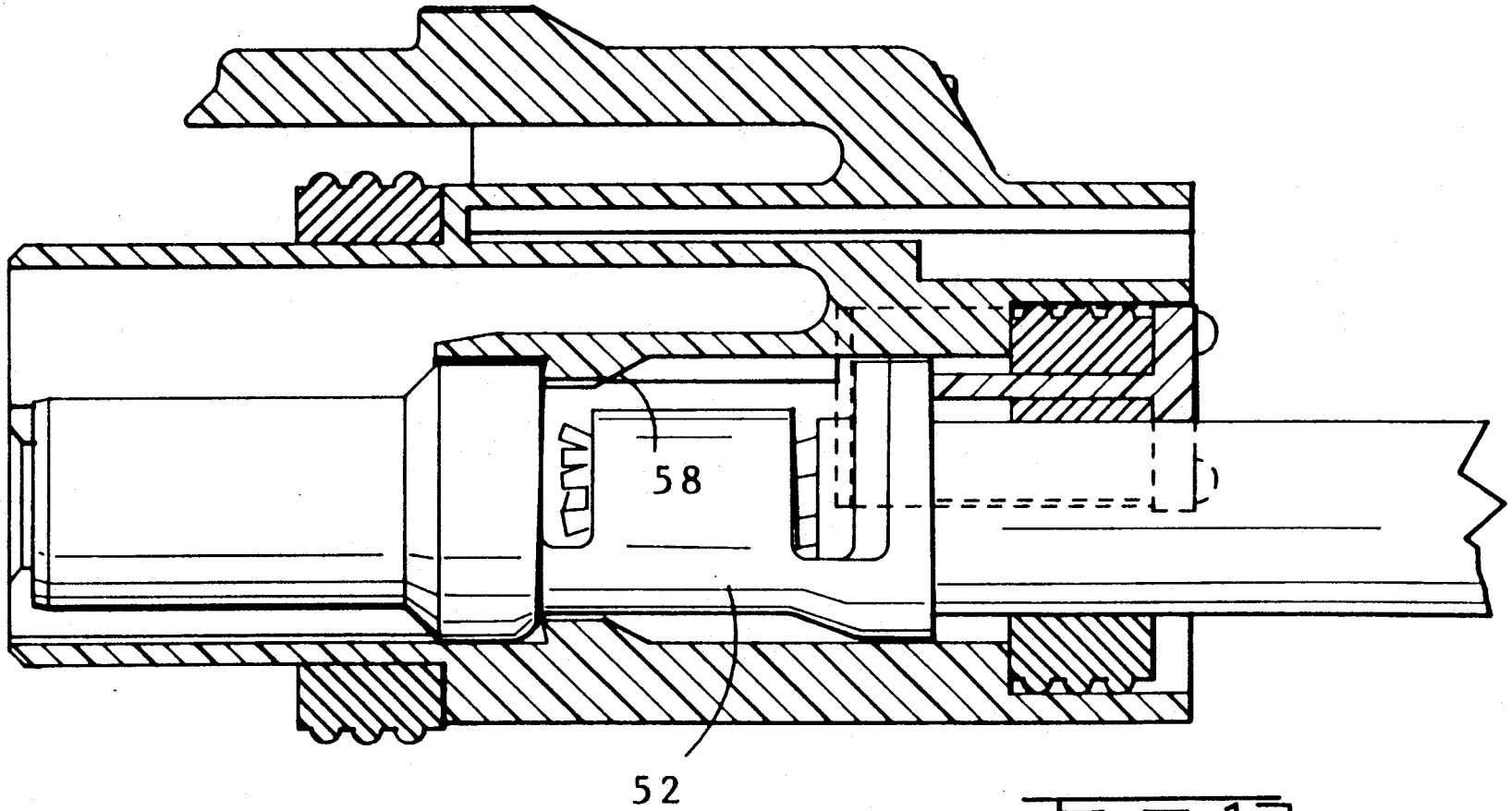
FIG. 12 is a sectional view of the single position plug housing with a socket terminal positioned therein.
Figure 17B:
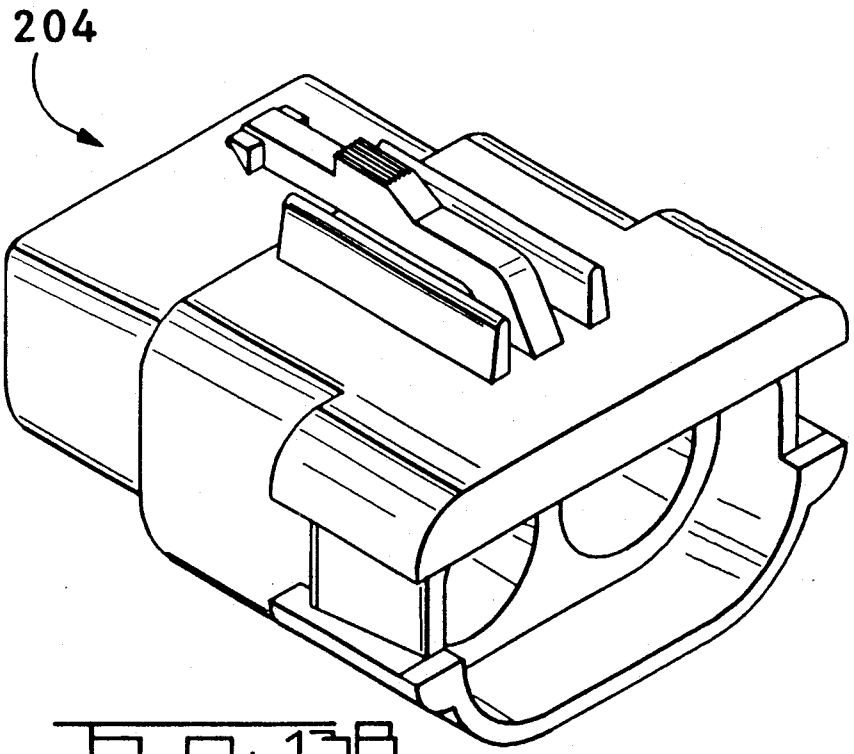
Figure 17A:
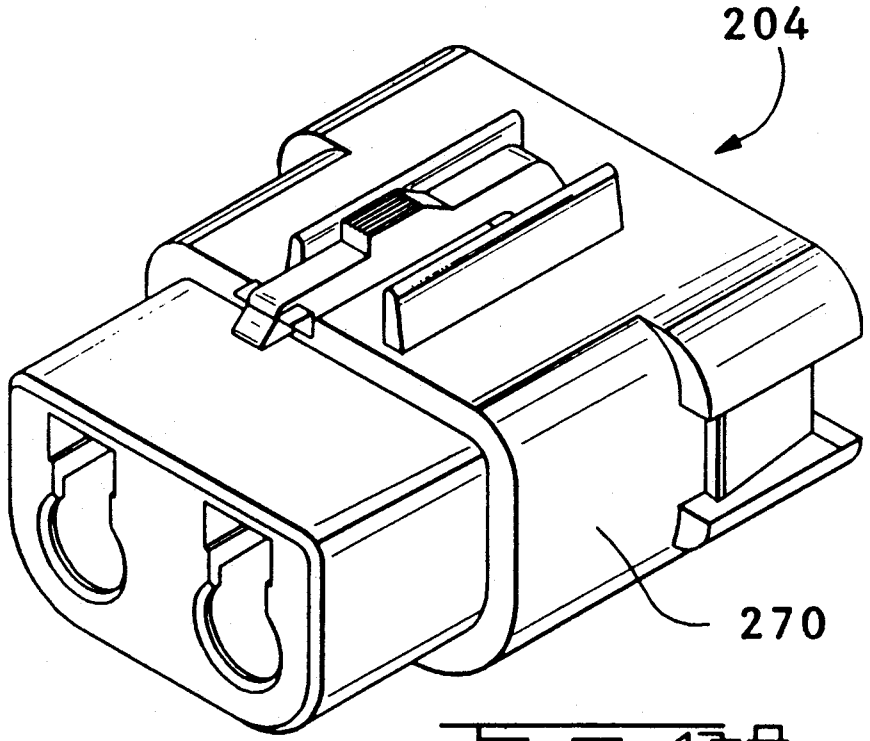

A conventional interfacial mating seal 130 is located at the forward end of the housings and has inner seal ribs 132 to form sealing integrity around the exterior of the plug housing 50 and outer seal ribs 134 to form sealing integrity with the inner surface of the interfacial sealing pocket 88 in the receptacle housing 70. Note that the secondary lock 100 is suitable for use in either a sealed or an unsealed configuration. As shown in FIG. 12, the secondary lock 100 is inserted with the projections 102, 110 located at the top in engagement with the rear stabilizing ring behind the point of engagement between the deflectable latch and the cylindrical bulge on the terminal The cylindrical bulge 14 and 34 of the terminals engages the inner surface of the corresponding cavities 52 and 72 so that both the pin and socket terminals are centered in either the sealed or unsealed configurations.

The preferred embodiment of this invention comprises a single position electrical connector. It should be understood, however, that a connector of this type can be used in multiple positions. FIG. 13 discloses a two position plug connector 204 including a two position plug housing 270, a two position secondary lock and a two position conductor seal. Sockets 10 and pins 30 can be used in this dual row plug connector or with a mating dual row receptacle connector, now shown. Sealing integrity with the housings, the conductors and with the secondary lock is established in the same manner as with the single position housing.

We claim:

1. An electrical connector comprising:

an insulative housing and at least one contact terminal disposed within a cavity in the insulative housing;

a secondary lock member having at least one cylindrical projection extending forward from a base located at the rear of the member and insertable into the rear of a corresponding cavity and engageable with a corresponding contact terminal to fully seat said terminal;

latching members disposed on the ends of said base of said secondary lock member and engageable with said insulative housing to secure said secondary lock member thereto; and a seal insertable into the rear of a corresponding cavity, the seal having an inner opening through which a contact terminal can be inserted and at least one concentric curved opening having the same center as the inner opening, each concentric curved opening being dimensioned to receive one corresponding cylindrical projection on the secondary lock and to establish sealing integrity therewith.

2. The electrical connector of claim 1 wherein a semicircular recess is formed on the upper surface of the base, each cylindrical projection being located at lease partially around the periphery of the semicircular recess.

3. The electrical connector of claim 2 wherein the contact terminals have a generally circular outer surface.

4. An electrical connector comprising:

an insulative housing and at least one contact terminal disposed within a cylindrical cavity in the insulative housing;

a secondary lock member having a projection extending from a base, the projection being insertable into the rear of a corresponding cavity and engagable with a corresponding contact terminal;

latching means on the secondary lock member engagable with the insulative housing;

the connector being characterized in that the secondary lock projection comprises a portion of a cylindrical surface having an axis corresponding to a longitudinal axis of the corresponding cavity.

5. The electrical connector of claim 14 wherein the contact terminals comprise either pin or socket terminals having a generally cylindrical cross section.

6. The electrical connector of claim 5 wherein the insulative housing includes a resilient latch protruding into the upper portion of each cavity, the secondary lock projection extending into the upper portion of the corresponding cavity.

7. The electrical connector of claim 6 wherein each contact terminal includes a cylindrical bulge in its midsection, and a circular stabilizing ring at the rear of the terminal, the resilient latch engaging the cylindrical bulge and the secondary lock projection engaging the stabilizing ring.

* * * * *

UNITED STATES PATENT AND TRADEMARK OFFICE

CERTIFICATE OF CORRECTION

PATENT NO. : 5,078,622

DATED : January 7, 1992

INVENTOR(S) : Alexander Hunt, III, Lori A. Mayer, Keith R. Denlinger

It is certified that error appears in the above-identified patent and that said Letters Patent is hereby corrected as shown below:

In CLAIMS, Claim 5, Column 8, Line 9 please delete the number "14" and replace it with -- 4 --.

Signed and Sealed this

Twenty-second Day of June, 1993

*Attest:*

Michael K. Kirk

MICHAEL K. KIRK

*Attesting Officer*

*Acting Commissioner of Patents and Trademarks*